US006386952B1

(12) United States Patent
White

(10) Patent No.: US 6,386,952 B1
(45) Date of Patent: May 14, 2002

(54) SINGLE STATION BLADE SHARPENING METHOD AND APPARATUS

(75) Inventor: Christopher A. White, Staunton, VA (US)

(73) Assignee: Specialty Blades, Inc., Staunton, VA (US)

( * ) Notice: Subject to any disclaimer, the term of this patent is extended or adjusted under 35 U.S.C. 154(b) by 0 days.

(21) Appl. No.: 09/558,358

(22) Filed: Apr. 26, 2000

(51) Int. Cl.[7] ..... B24B 1/00; B24B 7/00

(52) U.S. Cl. ..... 451/45; 451/57; 451/65; 451/69; 451/194

(58) Field of Search ..... 451/45, 57, 65, 451/69, 194, 196, 231; 30/346.55, 346

(56) References Cited

U.S. PATENT DOCUMENTS 1,911,974 A * 5/1933 Shelton
2,692,457 A 10/1954 Bindszus
2,709,874 A 6/1955 Delafontaine
3,461,616 A 8/1969 Nissen et al.
4,718,197 A 1/1988 Rath
4,916,817 A 4/1990 Atwater
5,390,445 A * 2/1995 Giovanazzi et al. ..... 451/194
5,645,470 A * 7/1997 Ludwig ..... 451/45

* cited by examiner

*Primary Examiner*—Timothy V. Eley
(74) *Attorney, Agent, or Firm*—Lawrence E. Laubscher, Jr.

(57) ABSTRACT

A blade sharpening method and apparatus is characterized by sharpening the blade in a single station grinding assembly. The grinding assembly includes two opposed abrading wheels which interlock to form a nip for sharpening the blade. The wheels each include a first coarse portion for roughing an edge of the blade, a second fine portion for finishing the hone facet, and a third coarse portion for forming other facets adjacent to the hone facet. The wheels are specially contoured and have parallel axes tilted relative to the direction of travel of the blade. The striations formed on the facets of the blade by the abrading wheels extend at the same angle in both facets.

13 Claims, 3 Drawing Sheets

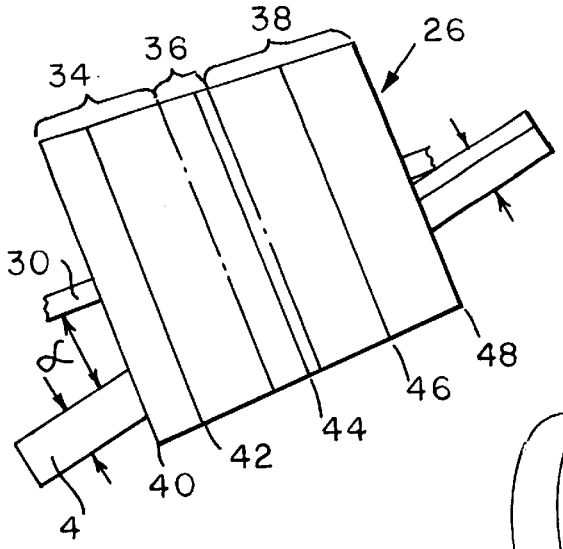
FIG. 7
FIG. 8
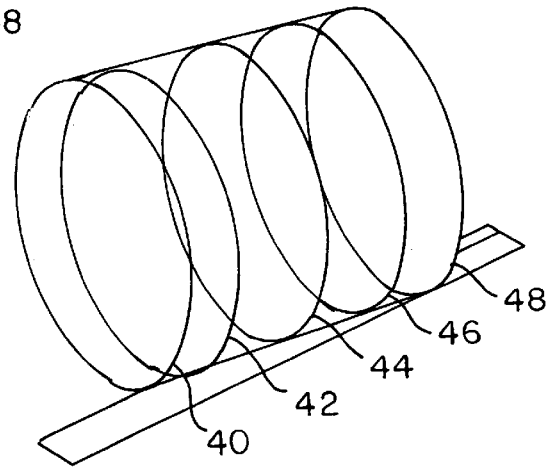
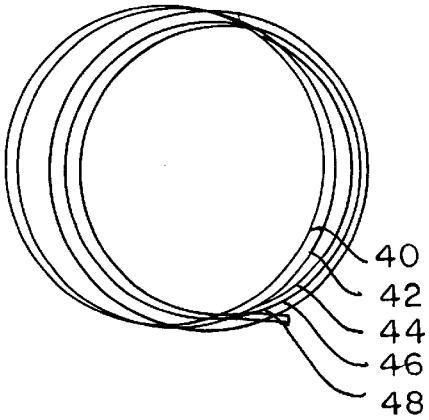
FIG. 9
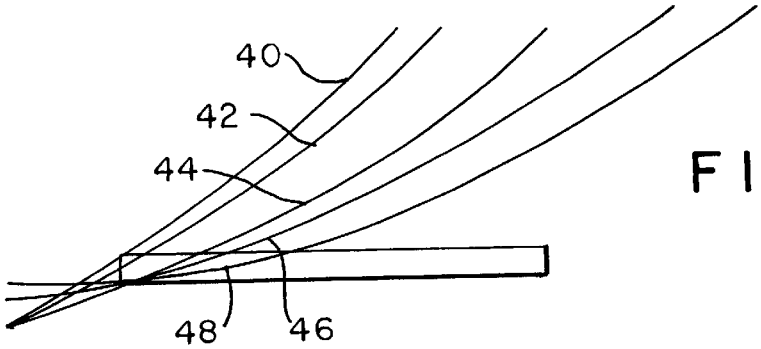
FIG. 10

SINGLE STATION BLADE SHARPENING METHOD AND APPARATUS

BACKGROUND OF INVENTION

High quality cutting blades are typically sharpened by using cylindrical abrasive wheels that are interlocked to form a nip. The blade passes axially along the abrasive wheels at the nip and material is removed forming facets on each side that intersect to form the sharpened edge of the blade. Standard practice utilizes successive stations of different coarseness to grind and finish the blade. Each station includes a pair of spindles and wheels and the associated mechanism to position and rotate the wheels. Thus, a first station utilizes coarse grit abrasive wheels to remove the largest amount of material. Subsequent stations utilize finer grits to hone the edge and frequently, a stropping station finishes the edge by straightening spot turn and removing burrs therefrom.

The interlocking of the wheels is typically accomplished by threading the pair of abrasive wheels with right and left hand grooves, respectively, and using a synchronized power transmission system to orient the groove of one wheel to the land of the other wheel. Alternatively, a plurality of spaced narrow abrasive discs can be used in place of the helically grooved wheels, with the discs of one assembly being interlocked with the discs of an oppositely positioned assembly.

The present invention relates to an improved method and apparatus for sharpening a blade in a single station and not finishing the edge at the end of a wheel.

BRIEF DESCRIPTION OF THE PRIOR ART

Multi-station blade sharpening devices are known in the patented prior art as evidenced by the Bindszus U.S. Pat. No. 2,692,457 and the Delafontaine U.S. Pat. No. 2,709,874. Bindszus and Delafontaine represent six and five station processes as typical for the manufacture of quality blades. The five-station process includes two grind stations, a rough hone, a medium hone, a final hone and a stropping station. As those familiar in the art would know, the initial and ongoing adjustments of a process with five abrasive stations is quite complex.

The process described in the Nissen et al U.S. Pat. No. 3,461,616 reduces the number of stations required for blade manufacture. Nissen et al discloses three separate stations including a grinding station, a first honing station, and a final honing station, the wheels of the final honing station being tilted relative to the direction of travel of the blade. In traditional or straight honing stations, alternating lands of the wheels slightly deform the edge of the blade in an alternating fashion at the exit of the honing wheel assembly producing a condition referred to as spiral turn. With the process described in the Nissen patent, the edge is formed at the beginning of the final honing assembly and the edge is not in contact with the wheels at the exit. This eliminates the need for a stropping station. A drawback to the Nissen arrangement is that these fine grit hone wheels must theoretically remove material instantaneously at the entrance to the honing assembly.

When an abrasive wheel forms a facet on a blade, patterns of scratch marks or striations are left on the surface of the facet by individual grains of the wheel. In an untilted abrading station, these striations are arranged in a pattern of lines virtually perpendicular to the edge of the blade. With a tilted finishing station, the striations of the grind facet are still perpendicular, but those on the hone facet are inclined at an angle.

Further reduction in the number of stations required for sharpening a blade is described in the Atwater U.S. Pat. No. 4,807,401. Here a dual-station blade sharpening apparatus in which the grinding and honing stations are tilted in opposite directions relative to the direction of travel of the blade is disclosed. This station arrangement results in a blade with striations in the grind facet arranged at a first angle relative to the edge and striations in the hone facet arranged at an oppositely-positioned angle to the edge. While an improvement over the prior three-stage sharpening devices, the Atwater apparatus still suffers from the drawback of requiring removal of the bulk of honed material at the entrance to the honing station.

The present invention was developed in order to overcome these and other drawbacks of the prior devices by providing a single station blade sharpening method and apparatus.

SUMMARY OF THE INVENTION

Accordingly, it is a primary object of the invention to provide a blade sharpening method and apparatus wherein a single pair of opposed grinding assemblies are mounted for rotation about parallel axes and define a nip for receiving a blade. The apparatus is capable of generating a multi-faceted blade. The grinding assemblies each include a first portion at an entry end for progressively removing a first portion of the blade to significantly reduce the amount of material to be removed in subsequent portions. A second portion of the grinding assemblies is adjacent to the first portion and hones the cutting edge of the blade at the desired included angle. The grinding assemblies also include a third portion adjacent to the second portion and at an exit end of the assemblies for removing material back from the edge at included angles lower than the edge facet. A support structure positions the grinding assemblies at an angle with respect to the direction of travel of the blade. The striations formed on the first and second facets thus extend at the same angle relative to the blade edge.

According to another object of the invention, the first and third portions of the grinding assemblies have relatively coarse grits and the second portion of the grinding assembly has a finer grit.

It is a further object of the invention to provide opposed specially contoured abrading wheels for the grinding assemblies. The wheel diameter varies from the entry end to the exit end on a functional basis. The third portion of the wheels which forms the lower angled facets do not contact the first facets honed by the second fine grit portion of the wheels.

According to another object of the invention, the wheels contain grooves arranged in opposite directions so that the wheels interlock to define a nip.

According to an alternate object of the invention, the grinding assemblies each comprise a plurality of spaced coaxial discs with the discs of the opposed grinding assemblies interlocking to define a nip.

BRIEF DESCRIPTION OF THE DRAWING

Other objects and advantages of the invention will become apparent from the following description when viewed in the light of the accompanying drawings, in which:

FIG. 7 is atop plan view of one of the grinding assemblies of the single station blade sharpening apparatus of FIG. 6; and FIGS. 8, 9, and 10 are schematic views of one of the grinding assemblies of the invention illustrating the different portions used to form and finish facets at the edge of the blade, respectively.

DETAILED DESCRIPTION

Figure 1:
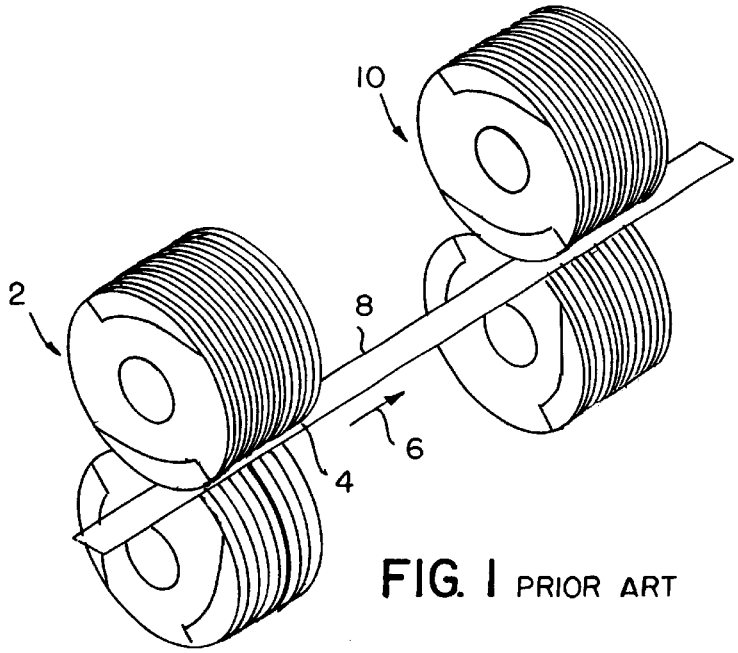
FIG. 1 PRIOR ART
FIG. 1 is a perspective view of two stations of a multi-station blade sharpening apparatus according to the prior art.

FIG. 1 shows two stations of a multi-station blade sharpening apparatus according to the prior art. The first station 2 is a grind station for removing the bulk of material from a blade 4 which travels in the direction of the arrow 6. The grind station forms a facet 8 on each side of the blade. A second station 10 is a honing station which produces a second set of facets that intersect at the edge of the blade. Additional stations may be provided to further hone or strop the blade.

Figure 2:
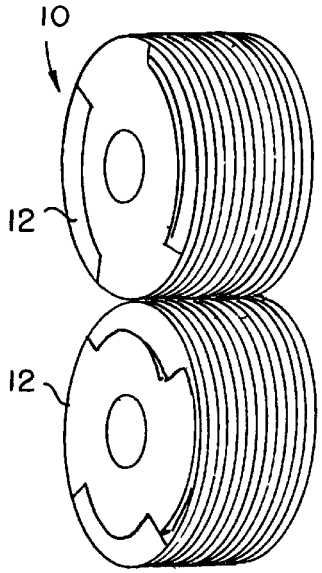
FIGS. 2 and 3 are perspective and detailed views, respectively, of interlocking abrading wheels defining a nip.
Figure 3:
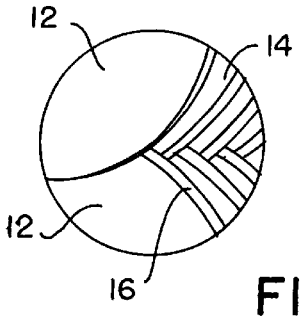
Figure 4:
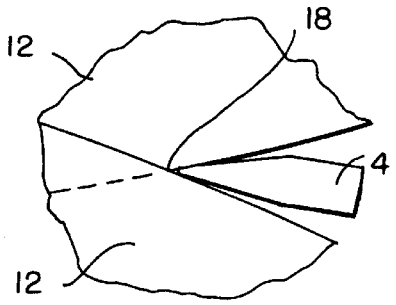
FIG. 4 is an enlarged, partially cut away axial view of opposed abrading wheels used to form facets on a blade.
Figure 5:
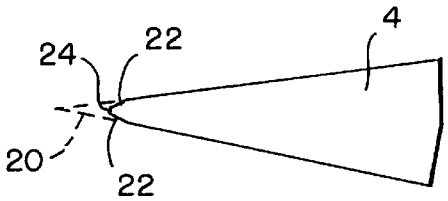
FIG. 5 is a side view of a blade illustrating the formation of facets on the two surfaces thereof.
Figure 6:
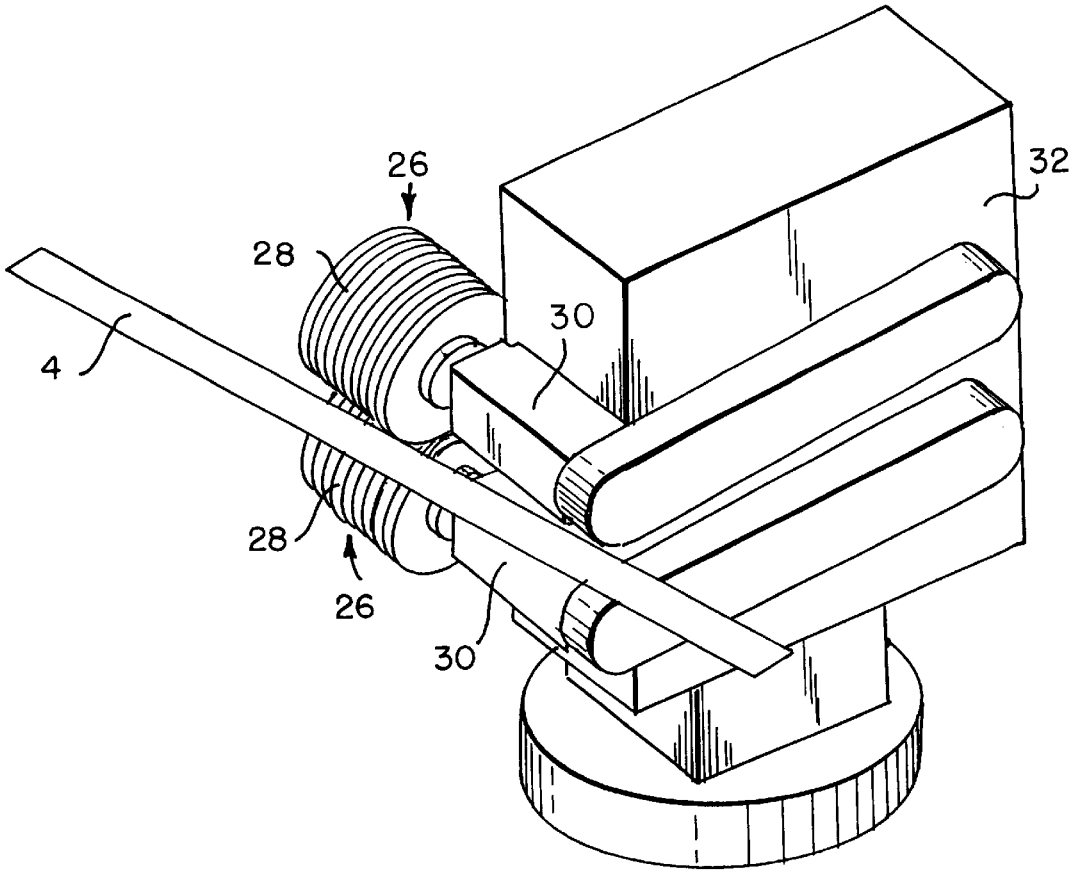
FIG. 6 is a perspective view of a single station blade sharpening apparatus according to the present invention.

Referring now to FIGS. 2 and 3, the hone station 10 is shown comprising a pair of abrasive wheels 12 which contain opposite grooves 14 so that the wheels interlock as shown in FIG. 3. The land 16 of one wheel is arranged in the groove of the other wheel. As shown in FIG. 4, the outer diameter of the interlocking wheels 12 define a nip 18 where the wheels meet. At the nip, the perimeter of the wheels remove material from each side of the blade to form facets at the blade edge. In FIG. 5, the material shown in phantom 20 of the blade represents the portion removed by the hone station. The facets 22 on the surfaces of the blade meet to define a sharp edge 24 of the blade.

The present invention will be described with reference to FIGS. 6–10. As shown therein, only one station is required to sharpen the blade 4. According to a preferred embodiment, the station includes a pair of opposed specially contoured abrading wheels 26 each of which contains oppositely directed grooves 28 so that the wheels interlock to define a nip in the same manner as shown in FIGS. 3 and 4. Each wheel is mounted on a spindle 30 for rotation about parallel axes. The spindles are connected with an adjustable support and drive mechanism 32 which controls the rotation of the spindles as well as the position of the wheels relative to the blade. As shown in FIG. 7, the axes of the wheels are tilted or arranged at an angle $\alpha$ relative to the edge of the blade 4.

The timing relationship of the rotating wheels is maintained by a power transmission system so that the wheels mesh and interlock properly. The transmission system is part of the drive mechanism 32. A diamond dressing tool under control of a computer (not shown) may be arranged adjacent to the wheels to contour the surface of the wheels to a desired configuration.

As will be developed below, one wheel grinds one side of the blade and the other wheel grinds the other side of the blade. Since the wheels operate in the same manner, the structure and operation of only one wheel will be described.

Each wheel has three portions along the axis thereof between an entry end of the wheel where the unsharpened blade enters the sharpening station and an exit end where the finished blade leaves the sharpening station. The first portion 34 of the wheel is an entry grind zone. In this portion, the wheel has a coarse grit to remove the bulk of the material from the each side of the blade in preparation of honing the first facet at the edge of the blade. A second portion 36 of the wheel is adjacent to the first portion and has a fine grit for honing the edge facet. The third portion 38 of the wheel follows the second portion and has a coarser grit for removing material from each side of the blade to form other facets back from the edge of the blade. It should be noted that the order of generation of the visible facets of the finished blade is notably different than previous art in that the lower angle grind facet is done last. The combination of the station tilt, $\alpha$, and a specially contoured profile wherein the radius of the wheel changes along its length, facilitates abrading the blade at different angles along its travel. Accordingly, within the first 34, second 36, and the third 38 portions are sectors on the outer surface of the wheel where the wheel radii perform different functions. These sectors are an entry sector 40, a mid-entry sector 42, an edge finishing sector 44, a mid-exit sector 46, and an exit sector 48. For ease in understanding the operation of the wheel at each sector, they are labeled on FIGS. 7–10.

The blade 4 enters the grinding assembly at the entry sector 40 in the first portion 34 of the wheels. At entry, the radius of the wheel just touches the corner of the blade. Because this portion of the wheel is relatively coarse, it is well suited for removing large amounts of material from the blade. Unlike the grinding assemblies of the prior art, the angle of contact of the wheel surface relative to the blade is higher at entry than the intended hone angle as best shown in FIG. 10. As the blade passes further into the grinding assembly and through the first portion of the wheels, the angle is lowered to just short of the desired edge angle. Thus, the angle at the mid-entry sector 42 is lower than the angle at entry 40 as shown in FIG. 10. Through the first portion 34 of the wheel, material is removed from the blade in a continuous and well-balanced manner by matching the decreasing wheel radii to the desired material removal rate.

When the blade passes the interface between the coarse first portion 34 and the fine second portion 36, almost all of the material has been removed from the edge of the blade and the included angle on the blade is only slightly higher than the intended hone angle. At the edge finishing section 44 within the second wheel portion 36, the edge of the blade is finished or honed at the desired included angle.

From this point, the blade advances through the remainder of the hone/second portion and into the third portion 38 which has a coarser grit. The contact angle of the wheel is further reduced (FIG. 10) and the radius of the wheel within the third portion is such that this portion does not contact the first facet defining the edge of the blade. The third portion removes material from the blade to form other facets thereon adjacent to the prior facet(s). At the exit sector 48, the angle of contact is the lowest and the radii are set to form a particular facet on the blade.

Because all of the grinding and honing is done in a single station, all of the striations visible on the facets of the blade will be at a single angle in accordance with the tilt angle $\alpha$ of the station.

For ease of explanation, the invention has been described as having only three distinct zones of grit coarseness. It will be appreciated that in alternative applications of the invention, a different number of distinct zones or a wheel with a continuously changing coarseness could be employed.

It will be appreciated that in alternative applications of the invention, the radii of the wheel along its length could be varied to work in conjunction with the station tilt a in such a way as to produce a blade with facet(s) of virtually any number and shape. A specific example might be to produce a single, continuous convex facet that starts at the edge and has decreasing included angles at increasing distances from the edge. Another example would be to produce a multi-faceted blade with a traditional concave hone facet and a convex second facet back from the edge.

While the grinding assemblies have been defined as comprising a pair of opposed helically grooved wheels, the wheels could each be replaced with a spaced series of abrading discs of varying diameter, with the discs of one series interlocking in the spaces of the other. The discs in the first and third portions of the series have coarse abrading surfaces while the discs in the second portion of the series have fine abrading surfaces. The configuration and orientation of the grinding assemblies, the speed of rotation of the wheels, and the tilt can all be varied to produce blade edges of a desired configuration. A number of parameters can be taken into account when designing the wheel contour, tilt, and rotation speed. These include the blade thickness, the hone angle, the width of the first or hone facet, the width(s) and angle(s) of the other facets, the amount of stock to be removed, the wheel radius that forms the ultimate edge, the total wheel width, the width of the coarse and fine portions, the position along the wheel where the edge is finished and the amount of stock to be removed by the wheel second portion. The wheel design can be determined manually or with the aid of computer software.

While in accordance with the provisions of the patent statute the preferred forms and embodiments of the invention have been illustrated and described, it will be apparent to those of ordinary skill in the art that various changes and modifications may be made without deviating from the inventive concepts set forth above.

What is claimed is:

1. A method for forming a cutting edge on a blade, comprising the steps of (a) forming a first facet on each side of the blade, said facets intersecting at a sharpened edge of the blade with a first entry portion of an abrading assembly;

(b) finishing said first facets of the blade with a second middle portion of an abrading assembly; and (c) forming at least one additional facet different from said first facet on opposing surfaces, respectively, of the blade adjacent to the first facets with a third portion of an abrading assembly, said first, second, and third portions of said abrading assembly being arranged in succession at a single station.

2. A method as defined in claim 1, wherein said facet forming and finishing steps comprise grinding the blade with multi-grit abrading assemblies arranged at an angle relative to said sharpened edge of the blade.

3. Apparatus for sharpening a multiple angled blade comprising (a) a single pair of opposed grinding assemblies mounted for rotation about parallel axes and defining a nip for receiving a blade, said grinding assemblies each including (1) a first portion at an entry end for removing a first portion of the blade to form a first facet on each side of the blade which intersect at a sharpened edge;

(2) a second portion adjacent to said first portion for finishing said first facet at said sharpened edge of the blade; and (3) a third portion adjacent to said second portion at an exit end of said grinding assemblies for removing at least a second portion of said blade adjacent to said first facets to form at least a second facet on each side of the blade; and (b) means for supporting said grinding assemblies with their axes at an angle with respect to said sharpened edge of the blade, whereby striations formed in all facets during removal of said first and second portions of the blade extend at the same angle with respect to said sharpened edge.

4. Apparatus as defined in claim 3, wherein said grinding assemblies each comprise abrading wheels with said abrading wheels of said pair of grinding assemblies interlocking.

5. Apparatus as defined in claim 4 wherein said first and third portions of said wheels have a coarse grit and said second portion of said wheels sandwiched between said first and third portions has a fine grit.

6. Apparatus as defined in claim 4, wherein one of said abrading wheels is threaded in a first direction and another of said abrading wheels is threaded in a second direction opposite to said first direction to facilitate interlocking thereof.

7. Apparatus as defined in claim 4, wherein said abrading wheels have a contoured configuration, with the contour of said first, second, and third portions determining the configuration of said facets.

8. Apparatus as defined in claim 7 wherein said portions of said wheels have different radii along the length of the wheel from an entry end toward an exit end.

9. Apparatus as defined in claim 7, wherein said third portions of said abrading wheels have radii different than said first portions, whereby said third portions of said abrading wheels form said second facets without contacting said sharpened edge of said first facets.

10. Apparatus as defined in claim 3, wherein said first and second facets have a convex configuration.

11. Apparatus as defined in claim 3, wherein said first and second facets have a concave configuration.

12. Apparatus as defined in claim 3, wherein one of said facets has a convex configuration and another of said facets has a concave configuration.

13. Apparatus as defined in claim 1, wherein said portions of each of said grinding assemblies comprise a plurality of spaced coaxial discs, said discs of said opposed grinding assemblies interlocking to define a nip.

* * * * *